United States Patent [19]

Wessel et al.

[11] 4,094,289

[45] June 13, 1978

[54] APPARATUS FOR IMPROVED PRECONDITIONING OF A FUEL-AIR MIXTURE

[75] Inventors: Wolf Wessel, Oberriexingen; Volkhard Stein, Stuttgart, both of Germany

[73] Assignee: Robert Bosch GmbH, Stuttgart, Germany

[21] Appl. No.: 738,924

[22] Filed: Nov. 4, 1976

[30] Foreign Application Priority Data

Dec. 12, 1975 Germany ..... 2555997

[51] Int. Cl.[2] ..... F02M 29/00

[52] U.S. Cl. ..... 123/141; 261/23 A; 48/180 R

[58] Field of Search ..... 123/141; 261/23 A, 65, 261/78 R; 48/180 R, 180 B

[56] References Cited

U.S. PATENT DOCUMENTS

| | | | |
|---|---|---|---|
| 772,530 | 10/1904 | McGee | 123/141 |
| 1,042,982 | 10/1912 | Sliger | 261/65 |
| 1,165,224 | 12/1915 | Cadett | 261/65 |
| 1,221,702 | 4/1917 | Douglas | 261/65 UX |
| 1,243,122 | 10/1917 | Winters | 261/65 X |
| 1,312,040 | 8/1919 | Mercier | 261/65 |
| 1,829,632 | 10/1931 | Chanard | 261/65 X |
| 2,597,780 | 5/1952 | Engnath | 261/23 A |
| 2,684,059 | 7/1954 | Schneider | 123/141 |
| 3,682,449 | 8/1972 | Severn | 261/23 A |

*Primary Examiner*—Charles J. Myhre
*Assistant Examiner*—Ira S. Lazarus
*Attorney, Agent, or Firm*—Edwin E. Greigg

[57] ABSTRACT

This disclosure relates to an improved apparatus for preconditioning of the fuel-air mixture in the induction tube of a mixture compressing and externally ignited internal combustion engine in which the throttle valve is provided with a multiple vaned valve structure that is pivotable about an axis extending transversely of the induction tube.

8 Claims, 2 Drawing Figures

APPARATUS FOR IMPROVED PRECONDITIONING OF A FUEL-AIR MIXTURE

BACKGROUND OF THE INVENTION

The invention relates to an apparatus for improving preconditioning of the fuel-air mixture in the induction tube of a mixture-compressing and externally ignited internal combustion engine with an arbitrarily actuated throttle device which cooperates with a coaxial preconditioning device also located in the induction tube and pivoting due to the force of the aspirated air against a restoring force.

In well-known fuel supply systems of this kind, the preconditioning of the fuel-air mixture within the suction tube is satisfactory only in certain specific regions of the revolutions per unit time or of the load conditions. Only within these regions wherein a thorough mixing of the air and the fuel takes place, and wherein, moreover, the fuel is finely vaporized, is a homogeneous mixture guaranteed for all the cylinders of the engine. However, within the other regions the cylinders of the engine receive a mixture that is too lean or too rich, resulting either in an unstable running of the engine, or in an especially high proportion of noxious exhaust gas constituents. Therefore, the danger exists, especially at full load, that an unsatisfactory precondition and distribution of the mixture will occur due to excessively low air velocities in the aspiration tube.

OBJECTS AND SUMMARY OF THE INVENTION

Accordingly, it is the primary object of the invention to develop an apparatus of the kind cited, with which a good preconditioning and distribution of the mixture, especially at full load, shall be assured.

This object is attained, according to the invention, by the fact that the throttle device which is carried in a lateral recess of the induction tube is actuatable in this recess in the direction of the opening thereof and opposite to the direction of the flow of the fuel-air mixture, and that in its idle position the throttle device lies adjacent to the preconditioning device which is constructed as a sector of a cylinder which extends transversely of the induction tube. Further, in this arrangement the preconditioning device trails the throttle device in its opening motion and swings into the recess against the restoring force through which a definite minimal pressure drop is maintainable at the preconditioning device during the full load attitude of the throttle device, and that the suction tube pressure downstream of the preconditioning device can be conducted via a throttle constriction to a space formed in the recess between the throttle device and the preconditioning device.

Because a definite minimal pressure drop is always maintained by the preconditioning device during the full load attitude of the throttle device, it is thus assured, even at full load, that a relatively high air velocity is always available for the dispersion of the fuel into the tiniest droplets.

An advantageous configuration of the invention consists in the fact that the preconditioning device, constructed in the form of a sector of a cylinder, is hollow, and that a spring, in particular a spiral spring, serves to provide the restoring force acting upon the preconditioning device.

According to another advantageous configuration of the invention, a throttle valve member serves as the throttle device.

The configuration of the throttle device in the form of a sector of a cylinder is equally advantageous.

Further objects and advantageous of the present invention will become more apparent to those skilled in the art from the following more detailed description and study of the appended drawings herein.

DESCRIPTION OF THE PREFERRED EMBODIMENTS

Figure 1:
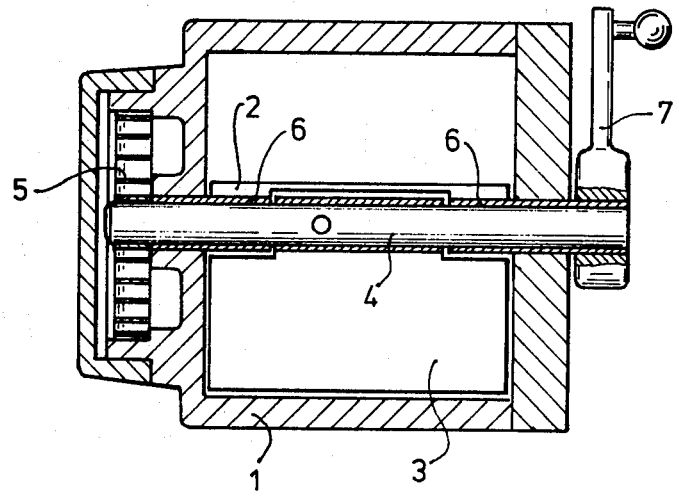
FIG. 1 is a transverse cross-sectional view through the induction tube showing the throttle device and preconditioning device.
Figure 2:
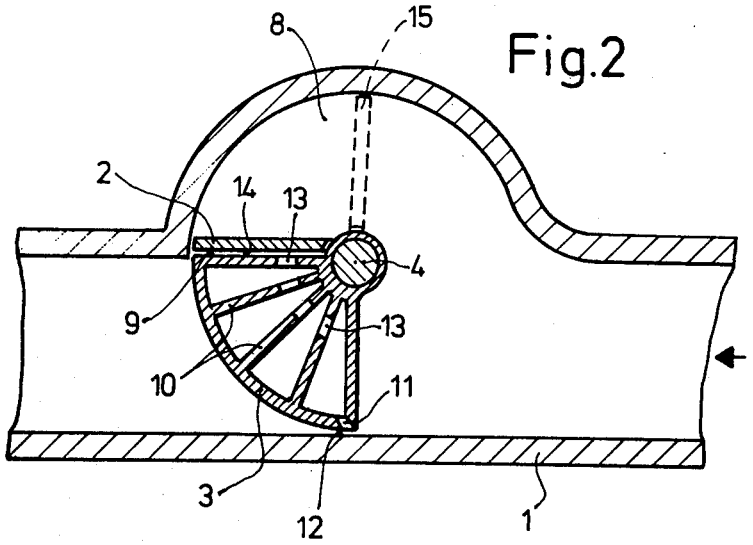
FIG. 2 is a longitudinal cross-sectional view through the induction tube showing the throttle device and preconditioning device.

In the exemplary embodiments of the invention depicted in FIGS. 1 and 2, the fuel-air mixture is formed, for example, in a carburetor or by the injection of fuel into the aspirated air through injection valves and flows in the direction of the arrow within an induction tube section 1 having a throttle valve member 2 and a preconditioning device 3 to the individual cylinders, not shown, of an internal combustion engine. The preconditioning device 3 is advantageously constructed in the form of a sector of a cylinder which extends transversely of the induction tube 1, the radius of which sector corresponds approximately to the diameter of the induction tube, and the cross section of which is approximately a quadrant. The preconditioning device 3 is firmly attached to a shaft 4, which extends transversely of the induction tube 1, and is rotatable in opposition to the force of a spiral spring 5. The throttle device is supported coaxially relative to the preconditioning device upon the shaft 4 by means of spaced bushings 6—6, and is arbitrarily manipulatable via a lever 7 by the accelerator pedal, not shown. The throttle device constructed in the form of a throttle valve member 2 is actuatable in a lateral recess 8 of the suction tube 1 in the opened direction opposite to the direction of flow of the fuel-air mixture. In the idle condition of the throttle valve member 2 the throttle valve member lies adjacent to the surface 9, turned away from the mixture current of the preconditioning device, and thereby holds the preconditioning device 3 in a position that nearly closes the induction tube. In FIG. 1 the throttle valve member 2 is shown in a slightly opened position. The lateral recess 8 of the induction tube section 1 is advantageously constructed cylindrically in such a manner as to permit both the throttle valve member 2 and the preconditioning device 3 to swing into the recess with the least possible circumferential gap. To save material costs and to keep the mass of the preconditioning device 3 as low as possible, it is appropriate to have the preconditioning device 3 constructed as a hollow cylinder sector. To achieve adequate stiffness, the interior of the preconditioning device can be provided with web plates 10 as shown. An opening 11 is located at the circumference of the preconditioning device 3, which opening communicates with the most constricted throughflow cross section 12 between the preconditioning device and the induction tube wall, and via which opening, and the openings 13 in the web plates 10 and in the surface 9, the pressure at the most constricted throughflow cross section 12 is conductible to the space 14 formed in the recess 8 between the throttle valve member 2 and the preconditioning device. However, the opening 11 may be omitted when the circumferential gap between the cylindrical circumference of the preconditioning device 3 and the wall of the recess 8 creates a definite throttle constriction between the suction tube section downstream of the preconditioning device 3 and the space 14. During an opening movement of the throttle valve member 2, for example, to the full load attitude 15 of the throttle valve, represented by the dashed lines and indicated at 15, the preconditioning device 3 follows the motion of the throttle valve due to the pressure differences prevailing at the preconditioning device until such time as the opening pressure force and the spring force of the spiral spring 5 are in equilibrium. The spring force of the spiral spring 5 is therein chosen such as to always maintain a definite minimal pressure drop at the preconditioning device 3 during the full load attitude 15 of the throttle valve, so that even during the full load condition relatively high air velocities are always available for good preconditioning and distribution of the mixture. In order to minimize the leakage of air flowing past the throttle device, it may be useful to also construct the throttle valve member 2 in the form of a cylindrical sector and in the manner of the construction of the preconditioning device 3.

It may similarly be advantageous to provide a labyrinth seal, especially one formed by radial concentric webs located at the side walls of the cylindrical sector, in order to tighten the seal between the side walls of the cylindrical sector facing the suction tube walls and the suction tube walls themselves.

What is claimed is:

1. Apparatus for improved preconditioning of the fuel-air mixture in the induction tube of a mixture compressing and externally ignited internal combustion engine with an arbitrarily manipulatable throttle valve, which cooperates with a coaxially arranged, induction tube contained, preconditioning device pivotable against a restoring force by means of the induction air quantity, further characterized in that the induction tube contains an integral laterally extending chamber having an arcuate interior surface into which the throttle valve and a multiple vaned pivotal throttle valve can be rotated.

2. Apparatus for improved preconditioning of the fuel-air mixture as claimed in claim 1, in which a plurality of said multiple vanes are assembled as a unitary structure.

3. Apparatus for improved preconditioning of the fuel-air mixture as claimed in claim 2, in which the unitary structure is a cylindrical sector.

4. Apparatus for improved preconditioning of the fuel-air mixture as claimed in claim 3, in which the cylindrical sector has a hollow interior.

5. Apparatus for improved preconditioning of the fuel-air mixture as claimed in claim 1, in which said multiple vaned pivotal throttle valve is maintained in a neutral inoperative position by elastic means.

6. Apparatus for improved preconditioning of the fuel-air mixture as claimed in claim 5, in which said elastic means is a spiral spring.

7. Apparatus for improved preconditioning of the fuel-air mixture in the induction tube of a mixture compressing and externally ignited internal combustion engine with an arbitrarily manipulatable throttle valve, which cooperates with a coaxially arranged, induction tube contained, preconditioning device pivotable against a restoring force by means of the induction air quantity, further characterized in that the induction tube contains a multiple vaned pivotal throttle valve and said induction tube further includes an integral laterally extending chamber into which at least one vane of said throttle valve is movable independently of other of said multiple vanes.

8. Apparatus for improved preconditioning of the fuel-air mixture in the induction tube of a mixture compressing and externally ignited internal combustion engine with an arbitrarily manipulatable throttle valve, which cooperates with a coaxially arranged, induction tube contained, preconditioning device pivotable against a restoring force by means of the induction air quantity, further characterized in that the induction tube contains an integral laterally extending chamber arranged to receive a multiple vaned pivotal throttle valve, in which a plurality of said multiple vanes are assembled as a unitary structure, and in which at least a portion of said multiple vanes being provided with means defining openings therein.

* * * * *